US005094166A

United States Patent [19]

Hendley, Jr.

[11] Patent Number: 5,094,166

[45] Date of Patent: Mar. 10, 1992

[54] SHAPE CHARGE FOR A PERFORATING GUN INCLUDING INTEGRATED CIRCUIT DETONATOR AND WIRE CONTACTOR RESPONSIVE TO ORDINARY CURRENT FOR DETONATION

[75] Inventor: Edward L. Hendley, Jr., Angleton, Tex.

[73] Assignee: Schlumberger Technology Corporpation, Houston, Tex.

[21] Appl. No.: 616,725

[22] Filed: Nov. 20, 1990

Related U.S. Application Data

[60] Continuation of Ser. No. 463,104, Jan. 10, 1990, abandoned, which is a division of Ser. No. 346,107, May 2, 1989, abandoned.

[51] Int. Cl.[5] ..... F42B 3/13

[52] U.S. Cl. ..... 102/202.7; 102/202.8; 102/220; 102/306; 89/1.15

[58] Field of Search ..... 102/217, 218, 202.7, 102/202.8, 310, 306, 220; 89/1.15

[56] References Cited

U.S. PATENT DOCUMENTS

| | | | |
|---|---|---|---|
| 2,684,030 | 7/1954 | Muskat et al. | 89/1.15 |
| 2,699,721 | 1/1955 | Klotz, Jr. | 89/1.15 |
| 3,327,791 | 12/1964 | Harrigan | 175/4.55 |
| 3,366,055 | 1/1968 | Hollander, Jr. | 102/202.7 |
| 3,517,758 | 6/1970 | Schuster | 175/4.55 |
| 4,319,526 | 3/1982 | Dermott | 102/310 |
| 4,450,768 | 5/1984 | Bell | 102/307 |
| 4,638,712 | 1/1987 | Chawla et al. | 89/1.15 |
| 4,700,629 | 10/1987 | Benson et al. | 102/201 |
| 4,708,060 | 11/1987 | Bickes, Jr. et al. | 102/202.7 |
| 4,724,767 | 2/1988 | Aseltine | 102/307 |
| 4,729,315 | 3/1988 | Proffit et al. | 102/202.9 |
| 4,762,067 | 8/1988 | Barker | 142/313 |
| 4,777,878 | 10/1988 | Johnson et al. | 102/202.5 |
| 4,831,933 | 5/1989 | Nerheim | 102/202.5 |
| 4,843,964 | 7/1989 | Bickes, Jr. et al. | 102/202.5 |

FOREIGN PATENT DOCUMENTS

| | | | |
|---|---|---|---|
| 80264 | 1/1956 | Netherlands | 89/1.15 |
| 693164 | 6/1953 | United Kingdom | 102/306 |
| 2190730 | 11/1987 | United Kingdom . | |

OTHER PUBLICATIONS

Semiconductor Products, vol. 30, No. 5, 30 May 1987, "new semiconductor device" Washington U.S.

"Unique Features of SCBs" by P. D. Wilcox, Initiating and Pyrotechnic Components Division 2515.

*Primary Examiner*—Stephen Johnson

*Attorney, Agent, or Firm*—Henry N. Garrana; John H. Bouchard

[57] ABSTRACT

A new shape charge includes an integrated circuit semiconductor bridge detonating device responsive to ordinary current for triggering a switch in the detonating device and igniting a pyrotechnic composition on a small integrated circuit semiconductor bridge in the detonation device in response to the current, thereby igniting an explosive material in the shape charge and firing the shape charge. Since the integrated circuit detonating device is utilized, responsive to ordinary current for detonation, prior art detonating cords are not needed. A plurality of shape charges in a perforating gun are fired substantially simultaneously using the new shape charge of the present invention.

3 Claims, 3 Drawing Sheets

FIG. 1
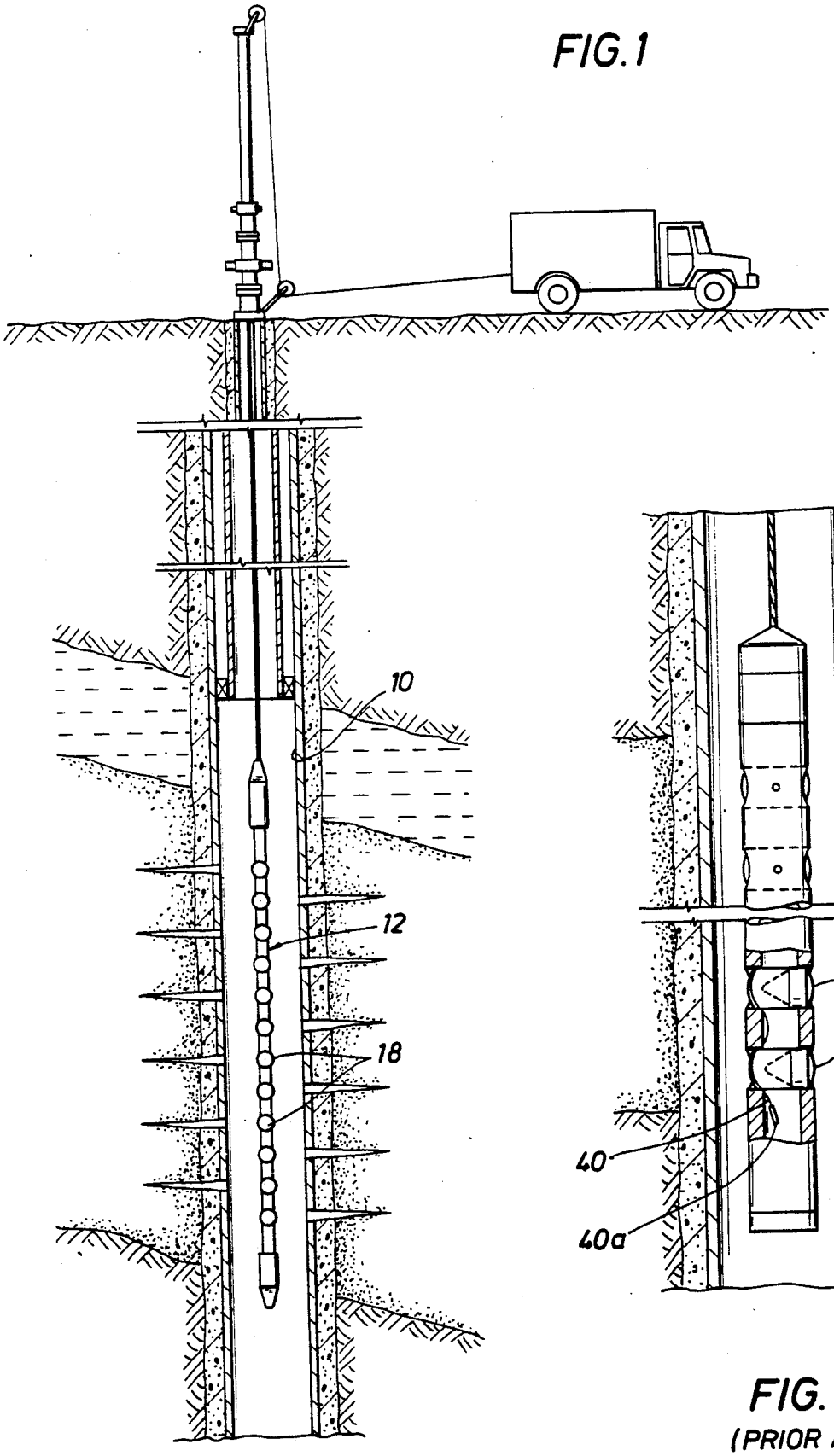
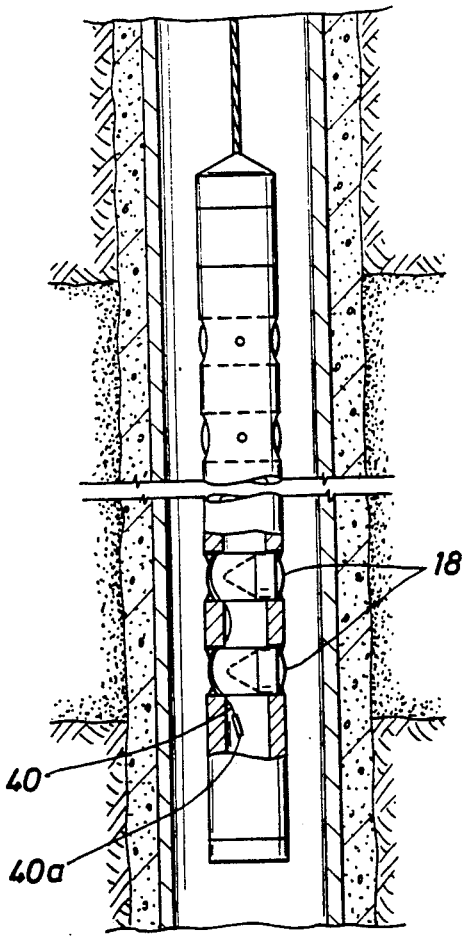
FIG. 2
(PRIOR ART)

FIG. 3
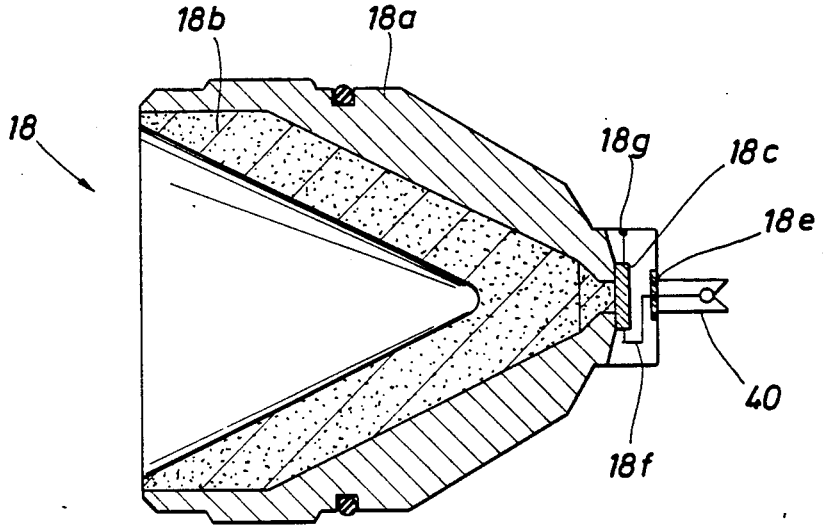
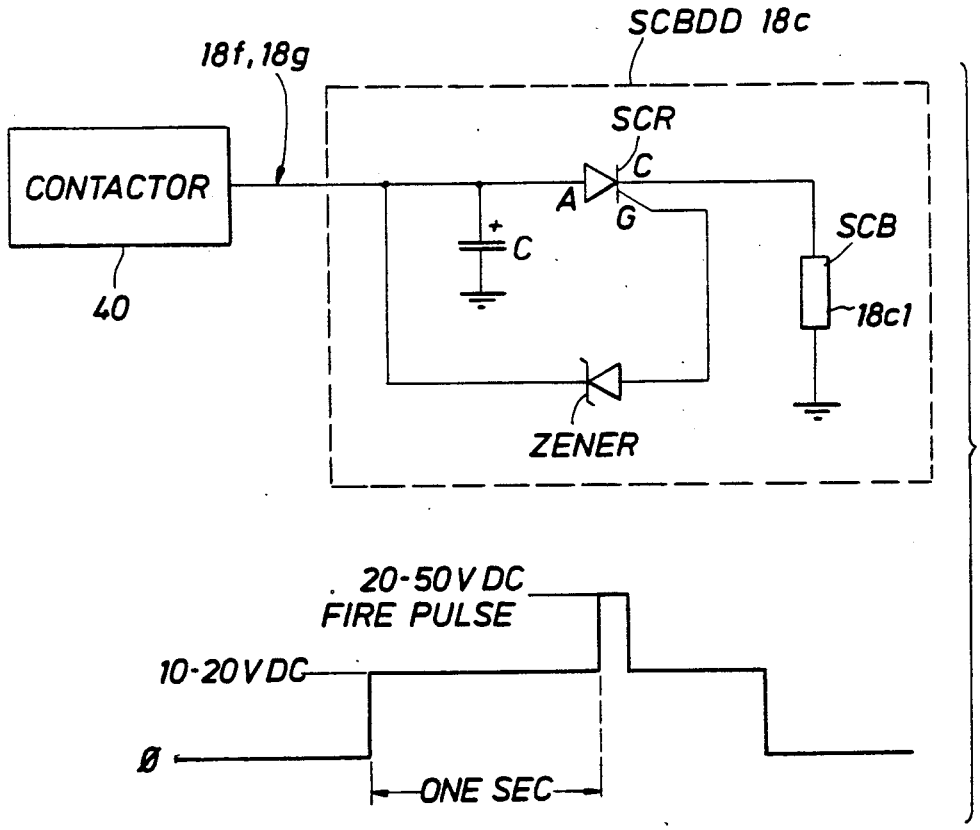
FIG. 6

SHAPE CHARGE FOR A PERFORATING GUN INCLUDING INTEGRATED CIRCUIT DETONATOR AND WIRE CONTACTOR RESPONSIVE TO ORDINARY CURRENT FOR DETONATION

This is a continuation of application Ser. No. 07/463,104 filed Jan. 10, 1990, which is a division of application Ser. No. 07/346,107 filed May 2, 1989, both now abandoned.

BACKGROUND OF THE INVENTION

The subject invention pertains to a new shape charge for use in a perforating gun, and more particularly, to a new solid state detonator for use in each such shape charge.

Perforating guns of the prior art generally include a plurality of shape charges, each charge containing an explosive material. A detonating cord is traditionally connected to each shape charge for detonating the explosive material in each charge when a heat source ignites the detonating cord. However, the detonating cord could be ignited when radio-frequency (RF) energy nearby induces a current in an input circuit high enough to ignite the cord. Therefore, elaborate steps must be taken to ensure that RF energy does not inadvertently detonate the charges in the perforating gun. Such steps have thus far concentrated on utilization of sophisticated input circuits designed to create large current surges that ultimately ignite the detonating cord. Use of detonating cords creates a safety risk; thus, such detonating cords must be handled carefully to avoid accidents. Of course, when detonating cords are used, shape charges in the perforating gun must be detonated sequentially, since the charges cannot be detonated simultaneously. All of these considerations reflect the need for a new type of shape charge, one which is immune to RF energy, one which does not use detonating cords to reduce the safety risk, and one which allows all shape charges in the perforating gun to be detonated substantially simultaneously.

SUMMARY OF THE INVENTION

Accordingly, it is a primary object of the present invention to provide a new shape charge, adapted for use in a perforating gun, which does not require the use of a traditional detonating cord for purposes of detonating the charge.

It is a further object of the present invention to provide a new shape charge, for use in a perforating gun, which contains an integrated circuit chip, which chip includes a solid state detonator for detonating the charge.

It is a further object of the present invention to provide a new shape charge which utilizes a standard copper wire lead, called a contactor, for energizing the solid state detonator on the integrated circuit chip thereby firing the detonator and providing enough explosive potential to detonate the shape charge.

These and other objects of the present invention are accomplished by designing a shape charge, for use in a perforating gun, which contains an integrated circuit chip, the chip representing a solid state detonator for detonating the shape charge. The chip contains a semiconductor bridge (SCB) fully described and illustrated in U.S. Pat. No. 4,708,060, the disclosure of which is incorporated by reference into this specification. The chip is connected to a standard copper wire, called a contactor. The wire is energized on one end by a current of sufficient amplitude for firing the solid state detonator on the chip. The current charges a storage capacitor, the capacitor remaining charged to its maximum potential as a result of the sufficient amplitude of the incoming current. A bleeder resistor is disposed in parallel to the capacitor. However, in view of the sufficient amplitude of the incoming current, the capacitor remains charged even though some of the charge is bled to ground via the bleeder resistor. The capacitor and bleeder resistor are connected to a switch. When the switch is closed by a user, the charge on the capacitor energizes the integrated circuit chip in the charge and vaporizes a special bridge compound on the chip. When this occurs, enough energy is provided for detonating an explosive normally contained in the charge. As a result, no detonating cords, otherwise called prima cords, are used. The safety risk is reduced. Since a large current surge is needed to vaporize the bridge compound, the solid state detonator of the present invention is immune to RF energy, especially in view of the function of the bleeder resistor.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein FIG. 1 illustrates a perforating gun disposed in a borehole;

FIG. 2 illustrates in more detail a typical perforating gun which may be used as the perforating gun of FIG. 1, the gun having a conventional detonating cord connected to each shape charge;

FIG. 3 illustrates a new shape charge useful for incorporation into the perforating gun of FIG. 2;

FIG. 6 illustrates another input circuit connected to the semiconductor bridge of FIGS. 4*a*–4*b* which forms a part of the integrated circuit semiconductor bridge detonating device disposed in the shape charge of FIG. 3.

DETAILED DESCRIPTION OF THE PREFERRED EMBODIMENT

Figure 4A:
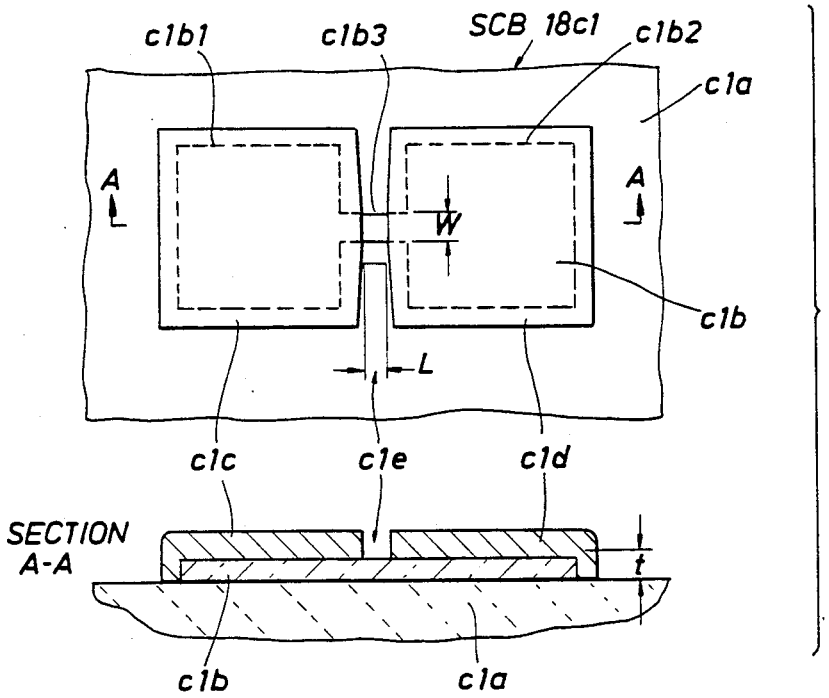
FIGS. 4*a*–4*b* illustrate the semiconductor bridge incorporated into the new shape charge of FIG. 3.

Referring to FIG. 1, a perforating gun 12 disposed in a borehole 10 is illustrated. The perforating gun 12 comprises a plurality of charges 18. Each charge perforates the formation upon detonation.

Referring to FIG. 2, a more detailed construction of a typical perforating gun, which may be used as the perforating gun of FIG. 1, is illustrated. The perforating gun of FIG. 2 is illustrated for purposes of example only, since it is necessary to illustrate in this specification a general environment in which a shape charge is located. Any perforating gun, which contains shape charges, may be used for purposes of this illustration. The perforating gun of FIG. 2 is fully described and set forth in U.S. Pat. No. 3,659,658 to Brieger, the disclosure of which is incorporated by reference into this specification.

In FIG. 2, a plurality of charges 18 are disposed in a typical perforating gun. A detonating cord 40 is connected to each charge 18. When the detonating cord 40 is ignited, via detonator 40*a*, each charge 18 in the gun is detonated sequentially.

Referring to FIG. 3, a new shape charge 18, in accordance with the present invention, is illustrated.

In FIG. 3, each charge 18 of FIG. 2 comprises a steel case 18*a*, an explosive material 18*b* disposed in the steel case 18*a*, a semiconductor bridge detonating device 18*c*, in accordance with the present invention, in contact with the explosive material 18*b*, a contactor 40 including electric current conductor 18*f* connected to one end of the semiconductor bridge detonating device 18*c*, and an electrical return path 18*g* connected to ground potential. The explosive material 18*b* may comprise any of the standard materials found in shape charges for perforating guns. For example, U.S. Pat. No. 4,724,767 entitled "shape charge apparatus and method" or U.S. Pat. No. 4,450,768 entitled "shaped charge and method of making it" disclose typical shape charges that contain standard explosive materials, the disclosures in these patents being incorporated by reference into this specification.

Figure 5:
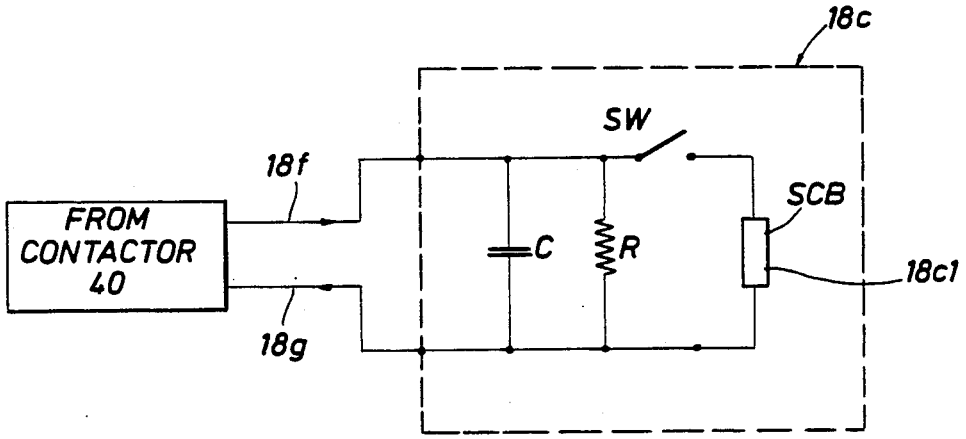
FIG. 5 illustrates an input circuit connected to the semiconductor bridge of FIGS. 4*a*–4*b* which forms a part of the integrated circuit semiconductor bridge detonating device disposed in the shape charge of FIG. 3.

Referring to FIG. 5, the semiconductor bridge detonating device (SCBDD) 18*c* of FIG. 3 is illustrated. The SCBDD 18*c* is an integrated circuit housed within the shape charge illustrated in FIG. 3. In FIG. 5, the SCBDD 18*c* includes a charging capacitor C connected in parallel with a bleeder resistor R. This parallel combination of charging capacitor C and bleeder resistor R is connected to a semiconductor bridge (SCB) 18*c*1 via a switch SW, which switch SW may be a standard silicon controlled rectifier (SCR). The SCB 18*c*1 is itself a portion of the Semiconductor Bridge Detonating Device (SCBDD) integrated circuit chip of FIG. 5.

Referring to FIG. 6, another embodiment of the semiconductor bridge detonating device (SCBDD) 18*c* of FIG. 3 is illustrated. As mentioned hereinabove, the SCBDD 18*c* is an integrated circuit housed within the shape charge illustrated in FIG. 3. In FIG. 6, contactor 40 is connected to a charging capacitor C via lines 18*f* and 18*g* from FIG. 3. The charging capacitor C is connected to the anode of a silicon controlled rectifier SCR. The gate G of the SCR is connected to a zener diode (zener), the zener being further connected to the contactor 40. The cathode C of the SCR is connected to the semiconductor bridge 18*c*1 (as further described with reference to FIGS. 4*a* and 4*b* below). The charging capacitor C charges to a voltage level between approximately 10 to 20 VDC. The zener diode breaks down at a voltage approximately equal to 25–30 VDC. The SCR fires when the gate voltage lies between 20–50 VDC.

Figure 4B:
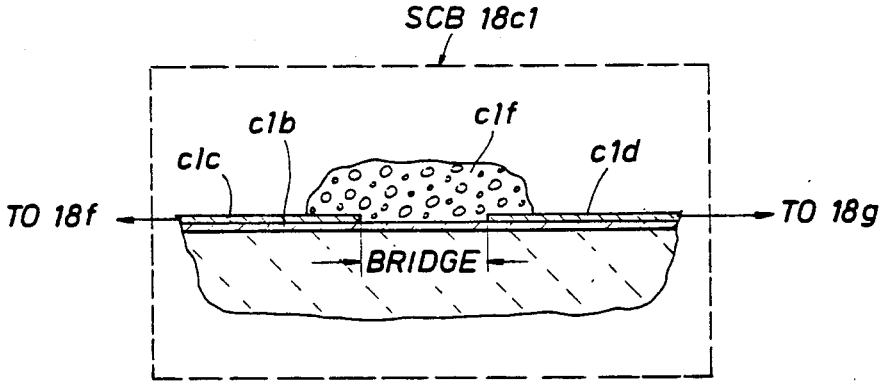

Referring to FIGS. 4*a*–4*b*, a further more detailed construction of the SCB 18*c*1 of FIG. 5 is illustrated. In FIG. 4*a* and 4*b*, a doped silicon layer c1b is deposited onto a sapphire substrate c1a. An aluminum land c1c is deposited onto one side of the doped silicon layer c1b and a further aluminum land c1d is deposited onto the other side of the doped silicon layer c1b so as to define a gap or bridge c1e between each land c1c/c1d. As noted in FIG. 4*b*, an explosive/pyrotechnic composition c1f bridges the gap c1e between land c1c and land c1d. When a current of sufficient magnitude energizes land c1c or c1d, the explosive/pyrotechnic composition vaporizes, which, in turn, ignites the explosive material 18*b* of FIG. 3 and detonates the shape charge 18. As noted is U.S. Pat. No. 4,708,060, the explosive/pyrotechnic composition c1f may comprise highly sensitive explosives as well as relatively insensitive ones, e.g., high energy explosives such as, but not limited to, PETN, HNAB, HMX, pyrotechnics, sensitive primaries, gun powders, etc.

The semiconductor bridge (SCB) 18*c*1 is fully described and set forth in U.S. Pat. No. 4,708,060 entitled "Semiconductor Bridge (SCB) Igniter", filed Feb. 19, 1985, issued Nov. 24, 1987, the disclosure of which is incorporated by reference into the specification of this application.

The sapphire substrate c1a is a non-electrically conducting substrate. The doped silicon layer c1b is comprised of an electrical material mounted on the non-electrically conducting sapphire substrate c1a and has a negative temperature coefficient of electrical resistivity at an elevated temperature, the doped silicon layer c1b covering an area of the sapphire substrate and defining a pair of spaced pads c1b1 and c1b2 connected by a bridge c1b3. The area of each of the pads c1b1 and c1b2 is much larger than the area of the bridge c1b3. The resistance of the bridge c1b3 is less than about three ohms. A metallized layer covers each of the spaced pads c1b1 and c1b2. An electrical conductor c1c and c1d is connected to each of the metallized layers. The electrical resistance between the electrical conductors (aluminum lands) c1c and c1d is determined by the electrical resistance of the bridge c1b3. The explosive/pyrotechnic material c1f covers the electrical conductor aluminum lands c1c and c1d so as to connect land c1c to land c1d. The area of the bridge c1b3 in contact with the explosive/pyrotechnic material c1f is sufficient to ignite the explosive material c1f when the bridge c1b3 forms a plasma (vaporizes) in response to an electrical current passing therethrough.

The above paragraphs describe a new shape charge 18 of FIG. 3 that is substituted for the charges 18 illustrated in FIG. 2 of the drawings. When each of the charges 18 in FIGS. 2 are replaced by the charge 18 shown in FIG. 3, the detonating cord 40 of FIGS. 2 must be replaced by contactor 40 of FIG. 3, the contactor 40 being a standard copper wire adapted for conducting an electrical current. As a result, since a new solid state detonating device is being used in each charge, the plurality of charges may be detonated substantially simultaneously by passing a current through the contactor 40 to each of the new charges illustrated in FIG. 3. Furthermore, the detonation takes place safely since a detonating cord is no longer needed.

A functional description of the present invention will be set forth in the following paragraphs with reference to FIGS. 1–5 of the drawings, and in particular, to FIGS. 3–5 of the drawings.

Referring to FIG. 2, a new perforating gun, in accordance with the present invention, includes a plurality of new shape charges 18, each charge of the gun being the charge 18 shown in FIG. 3 of the drawings. Item 40, attached to each new charge 18 in FIG. 2, is an ordinary copper wire, called a "contactor", identical to the contactor 40 shown in FIG. 3. Detonating cords, also known as primer cords, are not utilized with the new shape charges 18 of the new perforating gun of the present invention. When the new charges 18 are positioned in a desired location in a borehole and are ready for detonation, a current surge is transmitted down contactor wire 40 to each new charge 18, and along wire conductor 18*f* in FIG. 5. The current conducted along wire conductor 18*f* is a large current surge provided by, for example, any typical voltage multiplier circuit. The large current conducted along wire conductor 18*f* is high enough to charge the charging capacitor C in FIG. 5, even though bleeder resistor R continues to bleed some of the charge on capacitor C to ground. Switch "SW" may, for example, be a silicon controlled rectifier (SCR). When it is desired to detonate the new charges in the new perforating gun of the present invention, containing the charges shown in FIG. 3, when the charging capacitor C of FIG. 5 is fully charged, the user at the surface of a well transmits a further current down a separate wire connected to the SCRs of each SCBDD 18*c* of each charge 18, thereby firing the SCRs substantially simultaneously. When this occurs, the charge on capacitor C in each SCBDD 18*c* of each charge 18 conducts along land c1c of the SCB 18*c*1 to the explosive/pyrotechnic material c1f of the SCB 18*c*1. Since the current is a large current surge provided, for example, by a voltage multiplier circuit, the current is large enough to vaporize the explosive/pyrotechnic material c1f in each SCB of each SCBDD 18*c* of each charge 18 in the new perforating gun of the present invention. The vaporization of each pyrotechnic material c1f in the SCBs of each SCBDD 18*c* ignites the explosive material 18*b* in each charge 18 in the new perforating gun. The charges 18 detonate substantially simultaneously. No detonating cords or primer cords are utilized. Therefore, a safer perforating gun is the result.

A further functional description of the present invention will be set forth in the following paragraph with reference to FIGS. 3, 4, and 6 of the drawings.

When the charges 18 are located in the desired position within the borehole, a current is conducted down contactor wire 40 to all shape charges in the perforating gun. The current is further conducted along wire conductor 18*f* in FIG. 6. The charging capacitor C is charged to approximately 10–20 VDC. When the voltage on wire conductor 18*f* and across charging capacitor C reaches 25–30 VDC, the zener diode (Zener) breaks down, at which time, the 25–30 VDC appears on the gate G of the SCR. The SCR will fire when the voltage on gate G reaches a predetermined level, typically a voltage somewhere between 20–50 VDC. Assuming the SCR will fire when the gate G voltage reaches 35 VDC, after the Zener diode (zener) breaks down, and when the gate G voltage of SCR reaches 35 VDC, the SCR will fire, thereby allowing the 10–20 VDC charge on the charging capacitor C to flow to the SCB 18*c*1. This charge will flow through land c1c of the SCB, as shown in FIG. 4*b*, igniting the explosive/pyrotechnic composition c1f. When the composition c1f ignites, the explosive material 18*b* in the shape charge ignites, thereby firing the shape charge of FIG. 3. The shape charge was fired using ordinary current to trigger a switch in an integrated circuit in the shape charge, thereby firing a small integrated circuit semiconductor bridge, rather than using the obsolete prior art method of using detonating cords to fire the shape charge.

The invention being thus described, it will be obvious that the same may be varied in many ways. Such variations are not to be regarded as a departure from the spirit and scope of the invention and all such modifications as would be obvious to one skilled in the art are intended to be included within the scope of the following claims.

I claim:

1. A method of detonating a shaped charge adapted to be disposed in a perforating gun for perforating a formation traversed by a borehole, said shaped charge including an explosive material, a detonator disposed adjacent said explosive material and a conductor wire connected to the detonator adapted for conducting an input current, the detonator being an integrated circuit and including a charge storage means connected to said conductor wire, a bridge means including a first land, a second land, and a composition bridging the first land and the second land, a switch means having a terminal connected between the charge storage means and the bridge means for changing from a first state to a second state thereby connecting said charge storage means to said bridge means in response to a firing current conducting on said terminal, and means connected between said terminal of said switch means and the conductor wire for generating said firing current in response to said input current thereby changing said switch means from said first state to said second state but only when a voltage associated with said input current is greater than or equal to a predetermined level, comprising the steps of:

conducting said input current along said conductor wire to said shaped charge;

receiving said input current in said charge storage means of the integrated circuit detonator in said shaped charge and storing a charge therein;

changing a state of said switch means from said first state to said second state in response to said firing current;

receiving a further current from said charge storage means in said first land of said bridge means;

receiving said further current in said composition bridging said first land and said second land of said bridge means;

receiving said further current in said second land of said bridge means;

detonating said composition in said bridge means in response to said further current; and detonating said explosive material in said shaped charge in response to detonation of said composition of said bridge means.

2. A method of detonating a perforating gun adapted to be disposed in a borehole for perforating a formation traversed by said borehole, said perforating gun including a conductor wire adapted for conducting an input current and at least one shaped charge connected to the conductor wire, the shaped charge including an explosive material and a detonator connected between said explosive material and said conductor wire, the detonator being an integrated circuit and including a charge storage means connected to said conductor wire, a bridge means including a first land, a second land, and a composition bridging the first land and the second land, a switch means having a terminal connected between the charge storage means and the bridge means for changing from a first state to a second state thereby connecting said charge storage means to said bridge means in response to a firing current conducting on said terminal, and means connected between said terminal of said switch means and the conductor wire for generating said firing current in response to said input current thereby changing said switch means from said first state to said second state but only when a voltage associated with said input current is greater than or equal to a predetermined level, comprising the steps of:

conducting said input current along said conductor wire to said shaped charge in said perforating gun;

receiving said input current in said charge storage means of the integrated circuit detonator in said shaped charge and storing a charge therein;

changing a state of said switch means from said first state to said second state in response to said firing current;

receiving a further current from said charge storage means in said first land of said bridge means;

receiving said further current in said composition bridging said first land and said second land of said bridge means;

receiving said further current in said second land of said bridge means;

detonating said composition in said bridge means in response to said further current; and detonating said explosive material in said shaped charge in response to detonation of said composition in said bridge means of said integrated circuit detonator of said shaped charge.

3. The method of claim 2, wherein the means for generating said firing current comprises a zener diode.

* * * * *